United States Patent [19]

Preisler et al.

[11] Patent Number: 4,589,960

[45] Date of Patent: May 20, 1986

[54] ACTIVATED METAL ANODES AND A PROCESS FOR MAKING THEM

[75] Inventors: Eberhard Preisler, Erftstadt; Heiner Debrodt, Nordendorf; Dieter Lieberoth, Wertingen, all of Fed. Rep. of Germany

[73] Assignee: Hoechst Aktiengeselischaft, Fed. Rep. of Germany

[21] Appl. No.: 679,289

[22] Filed: Dec. 7, 1984

[30] Foreign Application Priority Data

Dec. 21, 1983 [DE] Fed. Rep. of Germany ..... 3346093

[51] Int. Cl.[4] ..... C25D 5/50; C25B 11/00

[52] U.S. Cl. ..... 204/37.1; 204/192 C; 204/290 F; 427/127

[58] Field of Search ..... 204/290 F, 37.1, 192 C; 427/127

[56] References Cited

U.S. PATENT DOCUMENTS

| | | | |
|---|---|---|---|
| 4,140,617 | 2/1979 | Dzhaparidze | 204/290 F |
| 4,235,697 | 11/1980 | Bennett | 204/290 F |
| 4,342,792 | 8/1982 | Brown | 204/290 F |
| 4,394,231 | 7/1983 | Nicolas | 204/290 F |

*Primary Examiner*—John F. Niebling

*Attorney, Agent, or Firm*—Connolly and Hutz

[57] ABSTRACT

The disclosure relates to activated metal anodes consisting essentially of zirconium, niobium, tantalum or titanium and having its surface area activated by means of metallic manganese; the manganese content at the anode surface area of more than 16 weight % decreases towards the interior of the anode, reaching 0 weight % along a path corresponding to ¼ of the thickness of the anode material, measured from the anode surface area.

The disclosure also relates to a process for making these metal anodes.

11 Claims, 2 Drawing Figures

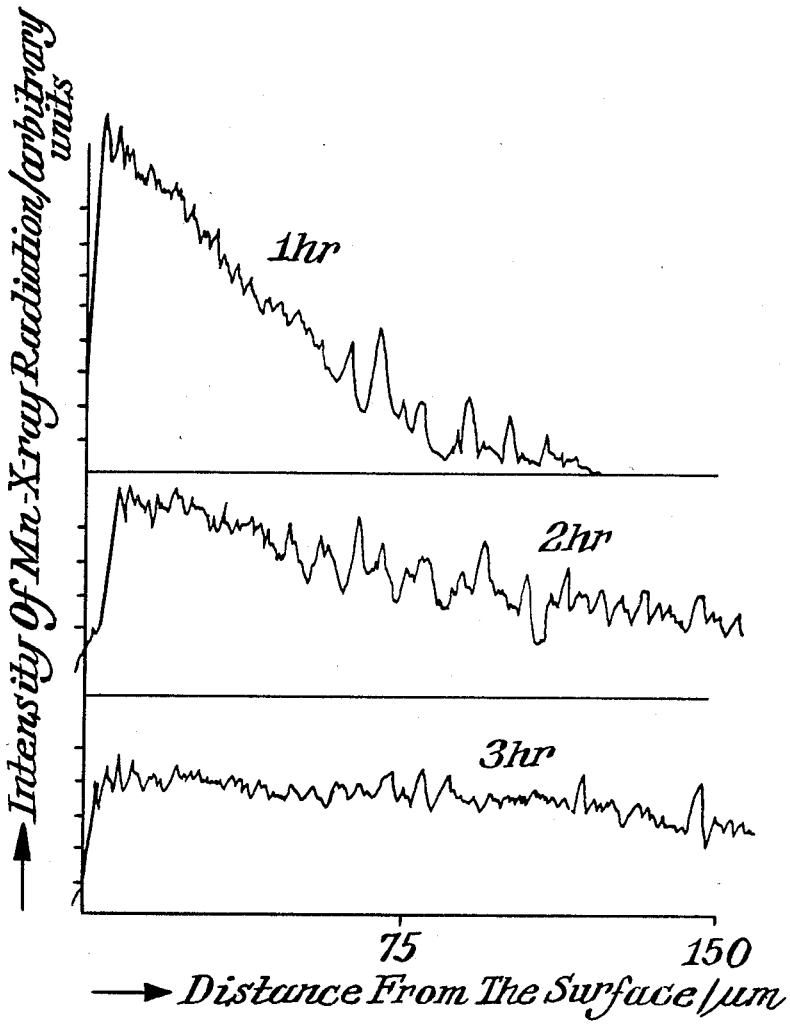
Fig.1. Manganese Profile Of Manganized Titanium Sheet, Manganese Layer: $2g \cdot dm^{-2}$ Temperature: 950°C. Annealing Period Under Vacuum 1,2 or 3 Hours Surface Concentration Of Mn: 60,45 and 30% (estimated)

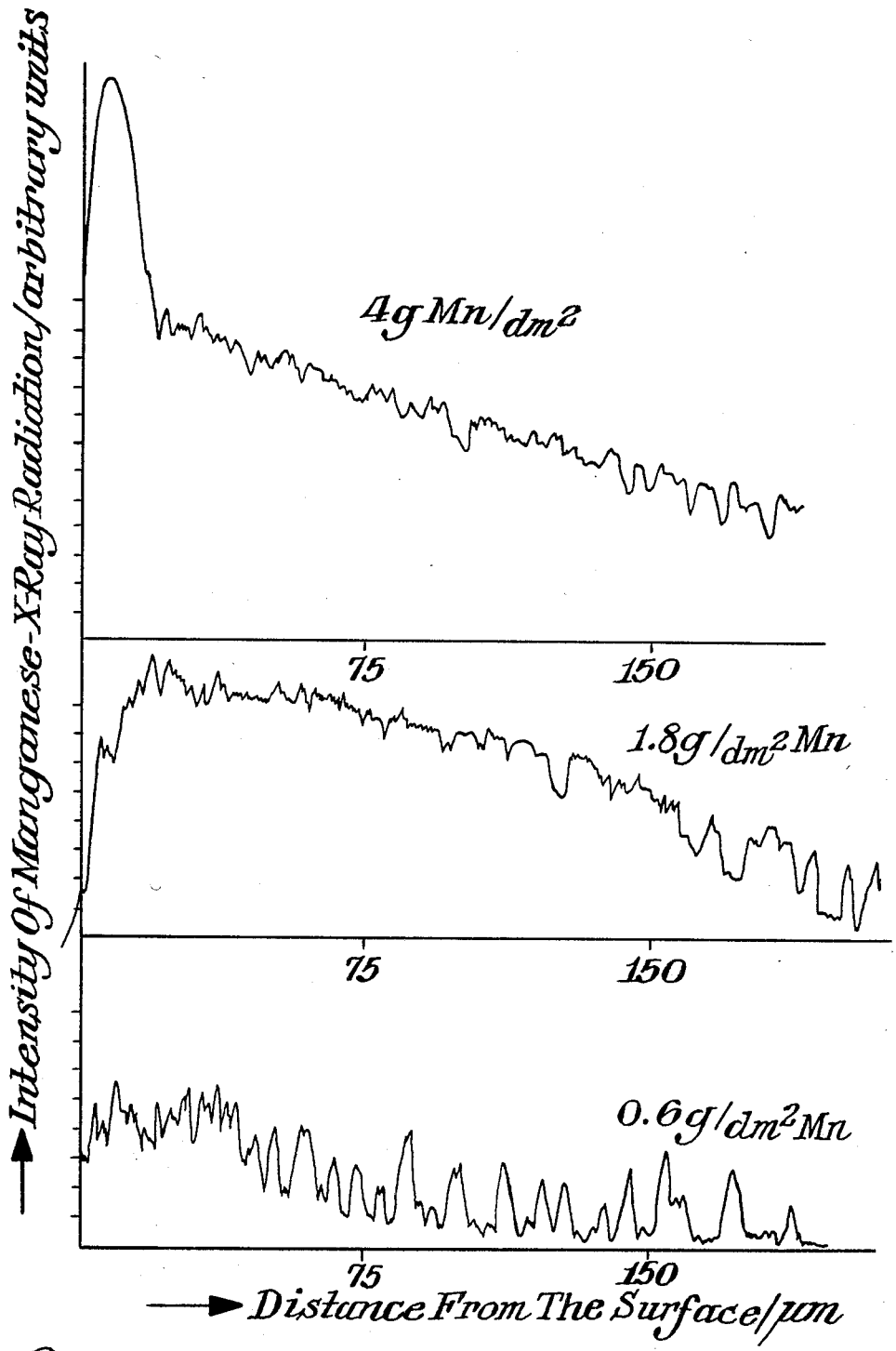
Fig. 2. Manganese Profile Of Manganized Titanium Sheet.
Annealing Period Under Vacuum: 1.5 Hours
Annealing Temperature: 950°C.
Manganese Layer: 0.6, 1.8 and 4 g/dm²

ACTIVATED METAL ANODES AND A PROCESS FOR MAKING THEM

The present invention relates to activated metal anodes, especially to anodes for use in electrochemical operations which provide for solid material to be precipitated on the anode, and to a process for making these anodes.

In industry, manganese dioxide made electrolytically (EMD) is precipitated on the anode in an electrolytic cell containing a hot sulfuric acid manganese sulfate solution as an electrolyte. After removal of the anode, the precipitated material is knocked off mechanically and worked up.

The materials used for making the anodes are selected from lead and its alloys, graphite or titanium. Each of these materials has typical advantageous or disadvantageous properties, but titanium has recently been gaining increasing interest as it is possible for a titanium anode to be used unchanged over prolonged periods, and as titanium practically fails to contaminate the final product, unlike lead alloys, for example.

In the event of titanium being used as the anode in an aqueous electrolyte, it is normally subject to the phenomenon of passivation. By anodic oxidation, a titanium dioxide layer commences forming on the anode surface area which admittedly prevents the non-noble titanium from undergoing further oxidation, but combines this with a very poor conductivity for electrons so that current flowing through the electrode indeed decreases very rapidly. In order to maintain the current constant, it is invariably necessary to provide for a higher terminal voltage. This is the reason why pure titanium is normally not of assistance in an electrochemical operation and why it has to be replaced by a so-called activated titanium anode, i.e. an anode coated with an activating noble metal-containing material, which already finds widespread commercial use, e.g. in the electrolysis of alkali metal chlorides.

Electrolytic manganese dioxide can however be made with the use of non-activated titanium as the anode inasmuch as, immediately after the formation of an extremely thin passive layer, a manganese dioxide layer commences precipitating thereon. This is manganese dioxide which is a relatively good conductor for electrons so that electrons rather than oxygen ions that freely migrate through the thin passive layer without the layer undergoing further growth, go into the boundary phase manganese dioxide/titanium dioxide, (cf. Chem. Ing. Techn. 49, 347 (1977)).

To prevent the passive layer of titanium under a layer of manganese dioxide from undergoing further growth, it is invariably necessary however to respect certain limits as to the conditions to be selected for electrolysis. Critical bath conditions include the current density, sulfuric acid concentration, manganese concentration and temperature. A titanium anode responds least sensitively to variations in the manganese concentration of the electrolyte, but responds very sensitively to temperature reductions. Inasmuch as the three critical operational parameters are closely corelated to each other, it is not possible accurately to determine absolute limiting values for each individual operational parameter. As results, it is only possible by continuous comparative tests under commercially interesting conditions to determine whether a titanium anode behaves advantageously or not.

In order to widen the limits just referred to which so critically determine the use of titanium in an EMD-electrolysis, it would appear to be quite suggestive to use titanium provided with an activating noble metal layer such as known from the electrolysis of alkali metal chlorides. These however are relatively loose active layers and they actually fail to resist the mechanical stress which occurs upon the precipitated EMD being knocked off since the precipitated EMD and thin active layer are very intimately intertoothed, so that the latter becomes indeed detached together with the EMD. Needless to say, very irregular inactivations are the result.

In order to avoid these difficulties, it has been suggested in DE-OS 16 71 426 that a layer rich in noble metal should conveniently be applied on to the titanium surface and subsequently be rendered insensitive to mechanical stress by a diffusion linkage resulting from annealing treatment under high vacuum or noble gas at about 950°–1000° C. This process is rendered commercially unattractive by the high noble metal price.

A titanium anode for use in another field, namely for the electrolysis of dilute sulfuric acid solution for the separation of water into oxygen and hydrogen has been described in SU-PS 891 905, the anode having sufficient stability during electrolysis at room temperature. The anode consists of a titanium/manganese-alloy containing between 6 and 16 weight % manganese and has its surface coated with a layer of $\beta$-manganese dioxide which is applied by subjecting manganese nitrate to multiple thermal decomposition. This electrode cannot however be used for the commercial production of electrolytic manganese dioxide (EMD) as the $\beta$-$MnO_2$-layer so applied lacks sufficient resistance to the mechanical stress which occurs upon the EMD being knocked off; it is carried along and it would be necessary for it to be newly produced, under circumstances after each electrolysis cycle.

A further adverse effect encountered with that electrode resides in the fact that titanium alloys containing more than 16 weight % manganese are brittle and can no longer be worked or formed mechanically. It should be added that titanium/manganese alloys containing considerably less manganese already cease to be rollable.

It is therefore an object of this invention to provide an anode, especially for the electrochemical production of manganese dioxide, which is free from the adverse effects described hereinabove, i.e. an anode which in the absence of an additional processing step can repeatedly be used for electrolysis under conditions under which pure titanium becomes passivated, the anode base remaining mechanically processable and formable, so that it is possible freely to select the anode configuration as if pure titanium were concerned.

To this end, the present invention now unexpectedly provides a metal anode consisting essentially of a metal selected from the group of the so-called "valve metals" including zirconium, niobium, tantalum or preferably titanium, the anode having its surface area activated by means of metallic manganese, the manganese oontent at the anode surface area of more than 16 wgt %, preferably 20–60 wgt %, decreasing towards the interior of the anode, reaching 0 wgt % along a preferred path corresponding to at most $\frac{1}{4}$ of the thickness of the anode material, preferably of 100–300 $\mu$m, measured from the anode surface.

The invention also provides a process for making the activated anodes which comprises applying a layer of metallic manganese on to the surface area of an anode base consisting of one of the valve metals zirconium, niobium, tantalum or preferably titanium and subsequently treating the anode over a period of 4 hours to 0.5 hour at a temperature between 800° and 1150° C., preferably 950° and 1100° C., in an inert atmosphere, e.g. a noble gas atmosphere, or under vacuum, longer treatment periods, within the limits specified, being selected at lower temperatures, within the limits specified, and shorter treatment periods, within the limits specified, being selected at higher temperatures, within the limits specified.

It is good practice to apply the manganese in a quantity of 0.5–3.0 g/dm$^2$, preferably 1.5–2.5 g/dm$^2$ on to the anode surface. The anode base should conveniently consist of commercially pure titanium selected from massive or sintered titanium.

The manganese should more preferably be applied electrolytically to the anode base.

In the event of the anode base consisting of sintered valve metal, it is possible to apply pulverulent manganese, which may be used in admixture with pulverulent valve metal, on to the anode surface. It is also possible to apply the manganese on to the anode base by sputtering.

The cathodic precipitation from an electrolyte containing manganese sulfate, ammonium sulfate, sulfuric dioxide and a selenium compound, e.g. selenious acid, has proved very advantageous.

The process of this invention permits the absolute manganese concentration at the anode surface and concentration gradients in the surface region to be varied within wide limits. This can be done by means of the quantity of manganese primarily applied to the anode base and also by means of the conditions selected for the subsequent thermal treatment. These measures should be balanced so as to have a manganese concentration higher than 16 wgt %, preferably 20–60 wgt %, at the anode surface.

The electrodes were used as anodes in the electrolytic production of manganese dioxide. The following test conditions were selected:

Composition of electrolyte:
- manganese 0.7 mol/l
- sulfuric acid: 0.5 mol/l
- temperature: 95° C.
- current density: 1.4 ampere/dm$^2$
- electrode size: 0.4 dm$^2$ (immersing)

The terminal voltage of the cell was registered in 10 day intervals of electrolysis, the manganese dioxide layer was removed, the electrode was reset in the bath and electrolysis was resumed. The initial terminal voltage was also registered.

EXAMPLE 1

An electrode consisting of a pure titanium plate with a surface area of 0.4 dm$^2$ dipping in the bath was used as an anode under the conditions specified. The initial terminal voltage was 2.3 volts; it reached 3.0 volts after 4 days, 4 volts after 8 days, and more than 10 volts on the 9th day.

EXAMPLE 2

The two sides of the titanium plate of Example 1 were ooated with 1.5 g/dm$^2$ metallic manganese by cathodic precipitation from a bath containing manganese sulfate and ammonium sulfate, and the titanium plate so coated was treated for 1 hour at 950° C. under argon as a protective gas. The electrode so made was tested under the same oonditions as in Example 1. The terminal voltage initially was 3.0 volts; after 10 days, it still was 3 volts. The EMD-layer was removed, the electrode was used again; the terminal voltage initially of 2.6 volts was again at 3.0 volts after 10 days. After the 50th cycle, the terminal voltage initially was 5.0 volts and finally was 3.3 volts.

EXAMPLE 3

In this Example, 1.25 g/dm$^2$ manganese was applied as described in Example 2 and the plate so coated was treated for 2 hours at 950° C. under argon. The electrolysis showed the same voltage path as in Example 2. After the 47th electrolysis cycle, the terminal voltage initially was 3.0 volts and finally was 3.3 volts.

EXAMPLE 4

Only 0.7 g/dm$^2$ manganese was applied in this Example and the heat treatment was carried out for 1 hour at 950° C. under high vacuum. During the 50th cycle of EMD-electrolysis, the terminal voltage initially was 2.8 volts and finally was 3.3 volts.

EXAMPLE 5

An electrode base of sintered titanium 8 mm thick was laid in distilled water over a period of 24 hours and immediately thereafter coated with 2 g/dm$^2$ manganese by cathodic precipitation from an electrolytic bath as described in Example 2. The electrode of sintered titanium was taken from the electrolytic bath, washed over a period of 24 hours in slowly running water and then dried at 110° C. Next, the electrode was treated for 1.5 hours at 950° C. under high vacuum and finally used for EMD-precipitation. The terminal voltage initially was 2.8 volts and finally was 3.0 volts after 10 days. After 28 electrolysis cycles, the terminal voltage finally was 3.3 volts.

The following two examples describe the preparation of sinter metal anodes activated by means of manganese with the use of pulverulent manganese.

EXAMPLE 6

A suspension of 70 parts pulverulent manganese consisting of particles with a size of less than 10 μm, 29.8 parts water and 0.2 part methyl cellulose was brushed on to the two sides of several sintered titanium plates 4 mm thick with the dimensions of 50×40 mm. Altogether 1.25 g pulverulent manganese was applied per dm$^2$ surface of the front and reverse sides. Next, the plates were dried at 90° C. for 20 minutes in a drying cabinet, and subsequently sujected to diffusion heat treatment under a vacuum of $10^{-7}$ bar over a period of 2 hours at 1050° C. After cooling, the surface had a regular gray metallic appearance.

Investigations by means of an electron-dispersive microanalysis indicated that the manganese content reaching from the surface to a depth of about 10 μm was about 45 wgt %. In a depth of 10 to 50 μm, the manganese content still was as high as about 10 to 20 wgt %, reaching practically zero in a depth of 250 to 350 μm.

Two of these specimens were used under the standard conditions of a manganese dioxide electrolysis. Manganese dioxide was precipitated at a sulfuric acid concentration of 50–55 g/l, a manganese ion concentration of 35–40 g/l, a temperature of 95° C.±2° C., and a current density of 1.30 ampere/dm$^2$. Graphite cathodes spaced apart from one another at 4 cm intervals were used as the counter electrodes.

The manganese dioxide formed was knocked off at 9–10 day periods of electrolysis. After altogether 15 electrolysis cycles with a cell voltage of 2.0 volt at the start and of 2.2 volt at the end of each cycle, the average current output was 95%, based on manganese dioxide freshly harvested.

EXAMPLE 7

A blend of 50 wgt % pulverulent zirconium consisting of particles with a size of less than 100 μm and 50 wgt % pulverulent manganese consisting of particles with a size of less than 60 μm was made into a pasty mass using a little methyl cellulose in water and the mass was applied by means of a spatula on to plates of sintered zirconium 6 mm thick. About 5.0 g/dm$^2$ was applied to the front and reverse sides. After drying at 90° C. under argon, the plates were sintered for 2 hours at 1100° C.

The sintering step results in the mass and plate becoming intimately connected together, a portion of the manganese diffusing even into the interior of the sintered zirconium core and becoming distributed as desired.

The electrolytic precipitation of manganese dioxide was effected under the conditions of Example 6. After 15 electrolysis cycles, the average current output was 95% and the cell voltages were between 1.9 and 2.2 volts during the electrolysis periods of 10 days in each particular case.

The process of this invention offers a series of technically beneficial effects which primarily reside in the fact that the anode can be given the configuration desired using the pure and still ductile valve metal; this compares favorably with an alloy containing relatively high proportions of manganese, which is known to combine brittleness with unprocessability. In addition to this, the anodes of this invention present a tough elastic core of pure metal improving considerably their resistance to mechanical stress, e.g. bending stress and impact stress, as compared with the resistance of anodes consisting of massive manganese alloys. A further advantage resides in that the production of the present anodes entails less expense than the production of anodes activated by means of a noble metal.

The following FIGS. 1 and 2 show manganese concentration gradients in titanium plates seen from the plate surface. The gradients were determined with the use of an electron-jet microprobe.

FIG. 1 shows the path of the manganese concentration and its dependence on the annealing period.

FIG. 2 shows the manganese radients and their dependence on the manganese quantity initially applied to the surface.

We claim:

1. An improved metal anode for use in electrochemical processes, said anode having a core of a first metal being coated with a second metal wherein (a) the first metal is a metal selected from the group consisting of zirconium, niobium, tantalum or titanium;

(b) the second metal is manganese;

(c) the manganese content at the anode surface area is greater than 16 weight %; and (d) the manganese content of the first metal in the said core decreases from the anode surface area towards the interior of the anode from more than 16 weight % to 0 weight % so that the manganese content of the first metal reaches the value of 0 weight % at a distance corresponding to ¼ of the over-all diameter of the anode measured from the anode surface area.

2. the anode as claimed in claim 1, wherein the manganese content at the anode surface area is 20 to 60 weight %.

3. The anode as claimed in claim 1, wherein the manganese content reaches 0 weight % along a path of 100 to 300 μm measured from the anode surface area.

4. A process for making an improved metal anode which comprises: applying a layer of metallic manganese on the surface area of an anode core consisting essentially of zirconium, niobium, tantalum or titanium and allowing the manganese to diffuse into the anode core metal by treating the anode over a period of 4 hours to 0.5 hour at a temperature between 800° and 1150° C. in an inert atmosphere or under vacuum, the heating periods selected being the longer the lower the temperature, and vice versa, within the limits of time and temperature specified.

5. The process as claimed in claim 4, wherein 0.5–3.0 g/dm$^2$ metallic manganese is applied on to the anode surface area.

6. The process as claimed in claim 4, wherien the anode base consists essentially of commercially pure titanium.

7. The process as claimed in claim 4, wherein the anode base consists essentially of sintered titanium.

8. The process as claimed in claim 4, wherein the manganese is applied electrolytically on to the anode base.

9. The process as claimed in claim 7, wherein pulverulent metallic manganese, optionally in admixture with pulverulent titanium, is applied to the anode base of sintered titanium.

10. The process as claimed in claim 4, wherein the manganese is applied to the anode base by sputtering.

11. An improved metal anode for use in electrochemical processes, said anode being made by the process of claim 4.

* * * * *